US009375743B2

(12) United States Patent
Chen et al.

(10) Patent No.: US 9,375,743 B2
(45) Date of Patent: Jun. 28, 2016

(54) SPRAY NOZZLE, SPRAYING DEVICE HAVING THE SPRAY NOZZLE AND METHOD FOR SPRAYING

(71) Applicant: Shenzhen China Star Optoelectronics Technology Co., Ltd., Shenzhen, Guangdong (CN)

(72) Inventors: Hui Chen, Shenzhen (CN); Chih-hao Chang, Shenzhen (CN); Wen-hua Wang, Shenzhen (CN); Chi-che Lin, Shenzhen (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 340 days.

(21) Appl. No.: 13/980,937

(22) PCT Filed: Jun. 27, 2013

(86) PCT No.: PCT/CN2013/078197

§ 371 (c)(1),
(2) Date: Jul. 22, 2013

(87) PCT Pub. No.: WO2014/190578

PCT Pub. Date: Dec. 4, 2014

(65) Prior Publication Data

US 2014/0356543 A1 Dec. 4, 2014

(30) Foreign Application Priority Data

May 30, 2013 (CN) ..... 2013 1 0209718

(51) Int. Cl.

| | |
|---|---|
| ***B05C 3/02*** | (2006.01) |
| ***B05B 1/14*** | (2006.01) |
| ***B05B 12/14*** | (2006.01) |
| ***B05B 1/04*** | (2006.01) |
| *B05B 9/06* | (2006.01) |
| *B05B 12/08* | (2006.01) |
| *B05B 13/04* | (2006.01) |

(52) U.S. Cl.
CPC ..... *B05B 12/1472* (2013.01); *B05B 1/044* (2013.01); *B05B 9/06* (2013.01); *B05B 12/08* (2013.01); *B05B 13/041* (2013.01)

(58) Field of Classification Search
USPC ..... 118/410, 411, 419, 323; 425/461; 239/548, 568; 427/427.3
See application file for complete search history.

(56) References Cited

U.S. PATENT DOCUMENTS

| | | | | |
|---|---|---|---|---|
| 5,976,256 | A * | 11/1999 | Kawano | B05B 15/02 118/407 |
| 6,344,088 | B1 * | 2/2002 | Kamikihara | B05C 5/0254 118/411 |
| 6,423,144 | B1 * | 7/2002 | Watanabe | B05C 5/002 118/410 |
| 6,537,376 | B1 | 3/2003 | Yasui | |
| 2002/0110640 | A1 * | 8/2002 | Tateyama | B05C 11/08 427/240 |

FOREIGN PATENT DOCUMENTS

CN 1611304 A 5/2005

* cited by examiner

*Primary Examiner* — Yewebdar Tadesse
(74) *Attorney, Agent, or Firm* — Andrew C. Cheng

(57) ABSTRACT

The present invention provides a spray nozzle, configured with left and right halves, at least one of the left and right halves being defined with a mating surface in which a recess defining width of a linear opening of the nozzle is defined, each end of the nozzle being mounted with fenders jointly define the linear opening of the nozzle along with the recess, wherein the mating surface in which the recess is defined further includes with a N number of partitions dividing the recess into a N+1 number of individual ejectors, wherein N is a positive integer. The present invention is to divide a single mouth of a spray nozzle of larger dimension into a plurality of individual ejectors with smaller dimension. During the acceleration or reduction of the spray nozzle, each individual ejector will deliver a homogeneous and even quantity of working liquid at central and end portions. The present invention further provides a spraying apparatus incorporated with such spray nozzle and a method for operating the spray nozzle.

8 Claims, 7 Drawing Sheets

SPRAY NOZZLE, SPRAYING DEVICE HAVING THE SPRAY NOZZLE AND METHOD FOR SPRAYING

FIELD OF THE INVENTION

The present invention relates to a spray nozzle for deploying photoresistance or the like across a glass substrate or other workload, and a spraying device having such spray nozzle and method for conducting the spraying.

DESCRIPTION OF PRIOR ART

Currently, during the manufacturing of the flat panel display, the glass substrate of large dimension is coated with a photoresistance by a nozzle with linear opening. The photoresistance is sprayed from the linear opening of the nozzle, forming an even and homogeneous layer of photoresistance across a surface of the glass substrate. FIG. 1*a* is perspective view of a prior art spray nozzle, and FIG. 1*b* is an exploded view of the spray nozzle shown in FIG. 1*b*. As shown in FIGS. 1*a* and 1*b*, the existing spray nozzle 100 includes left and right halves 110, 120 assembled together. The mating surface 121 of the right half 120 is planar, a photoresistance inlet 190 is defined at a middle portion of the right half 120. Meanwhile, in a middle portion of the left half 110 is defined a reservoir 130 extending along a longitudinal direction. The mating surface 141 is defined on an upper portion 140 of the reservoir 130 so as to mate with the right half 120. A lower portion 150 of the reservoir 130 is recessed as compared to the upper portion 140 as it is ground out. With this arrangement, a gap or slit is defined with the mating surface 121 of the right half 120, and this gap or slit becomes the linear opening 160 of the spray nozzle 100. Then, ends of the linear opening 160 are tightly blocked by left and right fenders 170 and 180.

FIG. 2 is a spraying device incorporated with the prior art spray nozzle. Referring to FIGS. 1*a*, 1*b*, and 2, the spray nozzle 100 is mounted onto a shuttle 210 which can travel along a horizontal x-axis 211 so as to carry the spray nozzle 100 to travel along the x-direction. During the displacement of the spray nozzle 100, a pump 220 mounted on the shuttle 210 will deliver the photoresistance to the spray nozzle 100, and then the pressurized photoresistance will by sprayed out from the spray nozzle 100 through the linear opening 160. And the photoresistance will be coated across the glass substrate supported on the table 230.

As shown in FIG. 1, the conventional spray nozzle 100 has a larger dimension at the traversal direction, and the entrance or inlet 190 of the photoresistance is located at the middle portion of the right half 120. When the spray nozzle 100 is acerbated or slowed down, the volume of the photoresistance delivered to the middle, and ends of the reservoir 130 from the inlet 190 are different. As a result, the photoresistance delivered to the middle, and ends of the linear opening 160 are less even.

On the other hand, in the manufacturing field of the flat display panel, the cost of the glass substrate is about 60% of the CF glass substrate which is formed with black array, RGB pixels. If the glass substrate is only cut into a single dimension, then the leftover blank of the glass substrate cannot be cut into a useable dimension. In recent year, the glass substrate is cut in a way of so-called multi-model glass, i.e. once the glass substrate is cut with a larger dimension, then the leftover blank is cut into a small dimension so as to increase the utilization rate, such as shown in FIG. 3. A whole blank glass substrate 300 is cut into a 43" panel 310, and the leftover blank of the glass substrate is cut into a 23" panel 210. Since in the existing spray nozzle, the thickness of the photoresistance sprayed over the surface of the glass substrate is even or the same. Accordingly, when a single blank of glass substrate is cut into different dimensions, the thickness of the photoresistance over the different sizes of the flat display panel has to be designed to be same. However, the thicker the thickness of the photoresistance, the corresponding colors are more vivid, i.e. the range of the RGB over the CF glass substrate is proportional to the thickness of the photoresistance. The increase of the thickness of the photoresistance will also reduce the light permeability. As a result, the selection of the backlight module for the CF glass substrate has also been affected. Accordingly, for the products of different dimensions, because of the difference from the dimensions, driving method and the design of the backlight module, it is hardly to have a single design for photoresistance applied to all kind of different products. Specially for the production of the small dimensions of the flat display panel, the thickness of the photoresistance for each size is different, however, the existing spray nozzle and the method to spay have created a great deal of inconvenience.

SUMMARY OF THE INVENTION

In order to resolve the technical problem encountered by the prior art, the present invention provides a spray nozzle, configured with left and right halves, at least one of the left and right halves being defined with a mating surface in which a recess defining width of a linear opening of the nozzle is defined, each end of the nozzle being mounted with fenders jointly define the linear opening of the nozzle along with the recess, wherein the mating surface in which the recess is defined further includes with a N number of partitions dividing the recess into a N+1 number of individual ejectors, wherein N is a positive integer.

In addition, wherein the mating surface of one of the left and right halves in which the recess is defined with N number of mounting slots each receives a corresponding partition, each of the partitions includes a mating surface closely in contact with a mating surface of the other half of the left and right halves, bottom of each of the partitions is flushed to bottom of one of the left and right halves in which the recess is defined.

In addition, wherein the N number of partitions are integrally formed with one of the left and right halves in which the recess is defined.

It is another object of the present invention to provide a spraying apparatus, including a working table for carrying and supporting a workload; a spray nozzle for spraying working liquid over the workload; a shuttle carrying the spray nozzle to move horizontally; a pump assembly delivering working liquid to the spray nozzle; a controlling system commanding the movement of the shuttle and adjusting administering rate of the working liquid to the spray shuttle; wherein the spray nozzle is configured with left and right halves, at least one of the left and right halves being defined with a mating surface in which a recess defining width of a linear opening of the nozzle is defined, each end of the nozzle being mounted with fenders jointly define the linear opening of the nozzle along with the recess, wherein the mating surface in which the recess is defined further includes with a N number of partitions dividing the recess into a N+1 number of individual ejectors, wherein N is a positive integer.

It is still another object of the present invention to provide a method to spray a working fluid across a workload by the spraying apparatus recited above, and includes the steps of 1) disposing the workload onto the working table; 2) adjusting the partition in aligning with a border of working zone of the workload to be sprayed; 3) determining pump rate of the pump assembly; and 4) commanding the movement of the shuttle to travel horizontally so as to spray a layer of film over the workload.

In addition, wherein the mating surface of one of the left and right halves in which the recess is defined with N number of mounting slots each receives a corresponding partition, each of the partitions includes a mating surface closely in contact with a mating surface of the other half of the left and right halves, bottom of each of the partitions is flushed to bottom of one of the left and right halves in which the recess is defined.

In addition, wherein the N number of partitions are integrally formed with one of the left and right halves in which the recess is defined.

In addition, wherein the pump assembly includes a N+1 unit pump each interconnected to a corresponding individual ejecting nozzle so as to deliver the working liquid thereto.

In addition, wherein the pump assembly includes one unit pump interconnected to all the individual ejecting nozzle so as to deliver the working liquid thereto.

In addition, wherein the spraying apparatus further includes N+1 number of flow meters, each of the flow meters being used to measuring flow volume of the working liquid to the corresponding individual ejecting nozzle; N+1 valves, each of the valves being used to adjust the flow volume to the corresponding individual ejecting nozzle; and a flow volume adjusting module adjusting the corresponding valve to control the flow of the working to the individual ejecting nozzle based on a feedback from the flow volume measured by the flow meter.

The present invention is to divide a single mouth of a spray nozzle of larger dimension into a plurality of individual ejectors with smaller dimension. During the acceleration or reduction of the spray nozzle, each individual ejector will deliver a homogeneous and even quantity of working liquid at central and end portions. On the other hand, when different working surfaces are required to spray with different thickness of working liquid, the flow rate entering to different individual ejectors can be set differently in aligning with the requirements. Accordingly, the administering rate of each individual ejector can be set accordingly and thereby delivering different thickness of working liquid over different working surfaces. In addition, if different working liquids are requested to deliver on different working surfaces, then each of the individual ejectors can be supplied with different working liquid so as to conduct the spraying of different working liquid over different working surface.

DETAILED DESCRIPTION OF PREFERRED EMBODIMENT

In the description given to the preferred embodiment in view of the accompanied drawings, like elements will be given with similar numeral references. Detailed description will be given to the embodiment in light of the accompanied drawings. In the accompanied drawings, for a better and clear description, certain portions and layers have been enlarged and widened so for a better description. In the description given below, in order to avoid any confusion resulted from the unnecessary description to any configurational structure or function of prior arts, those description in view of the prior art configuration and function has been omitted.

Figure 1A:
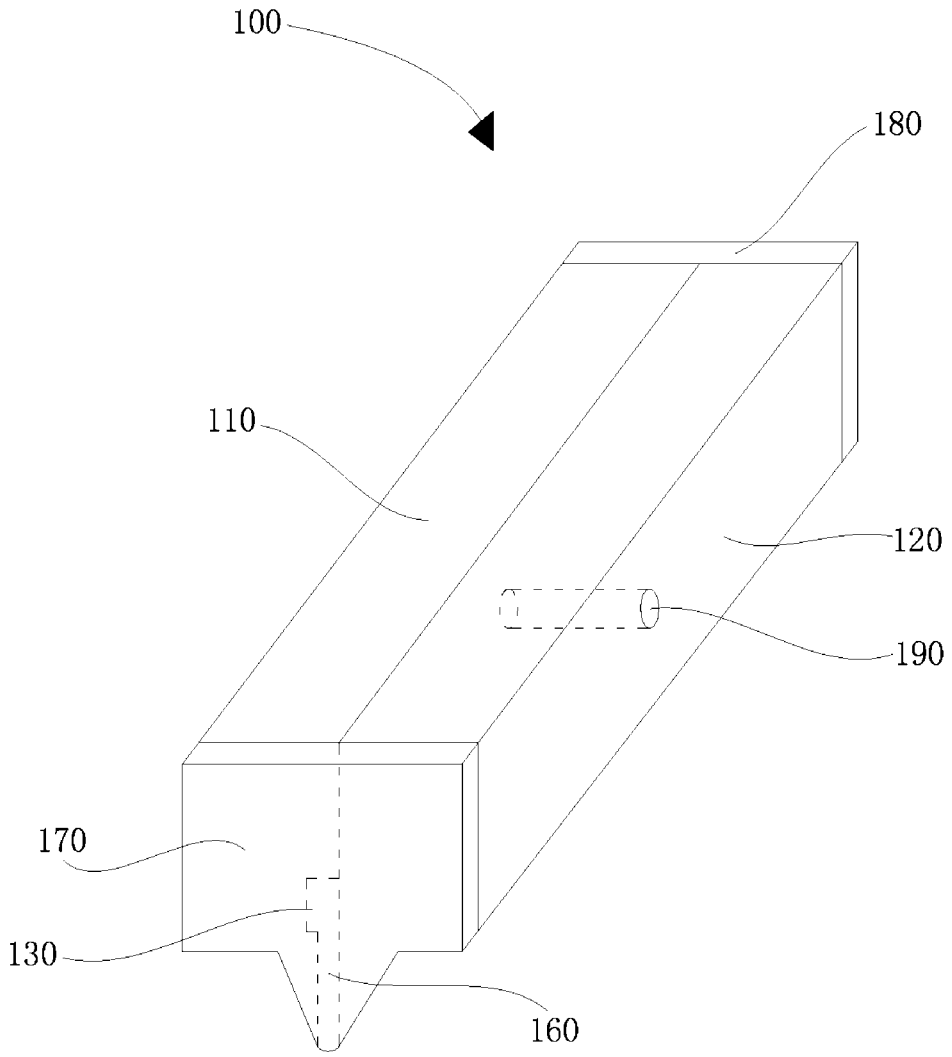
FIG. 1*a* is a perspective view of a prior art spray nozzle.
Figure 1B:
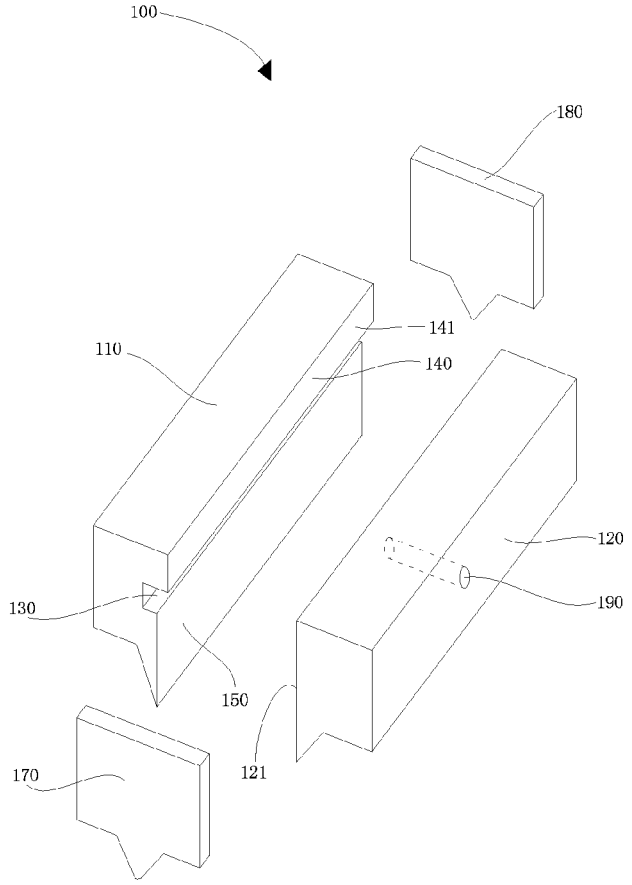
FIG. 1*b* is an exploded view of the prior art spray nozzle.
Figure 2:
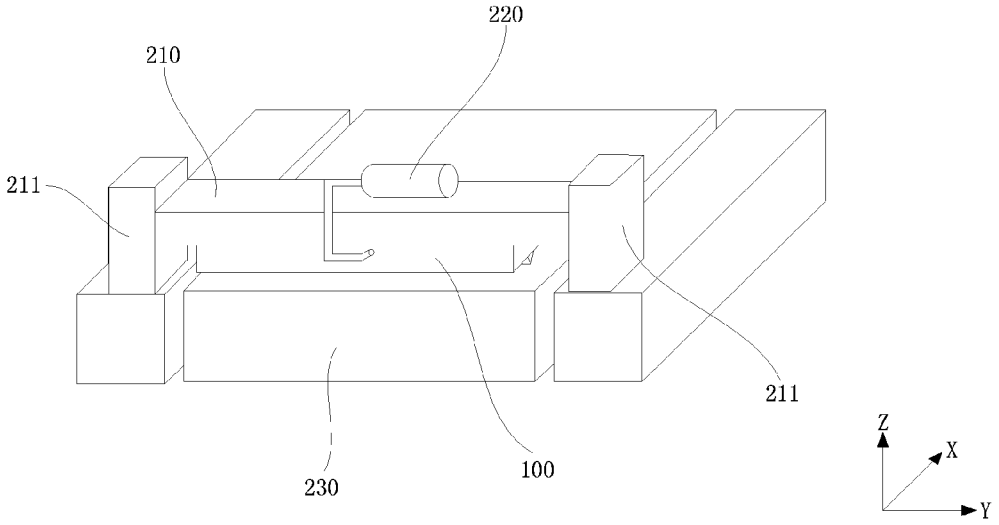
FIG. 2 is a spraying device incorporated with the spray nozzle of FIG. 1.
Figure 3:
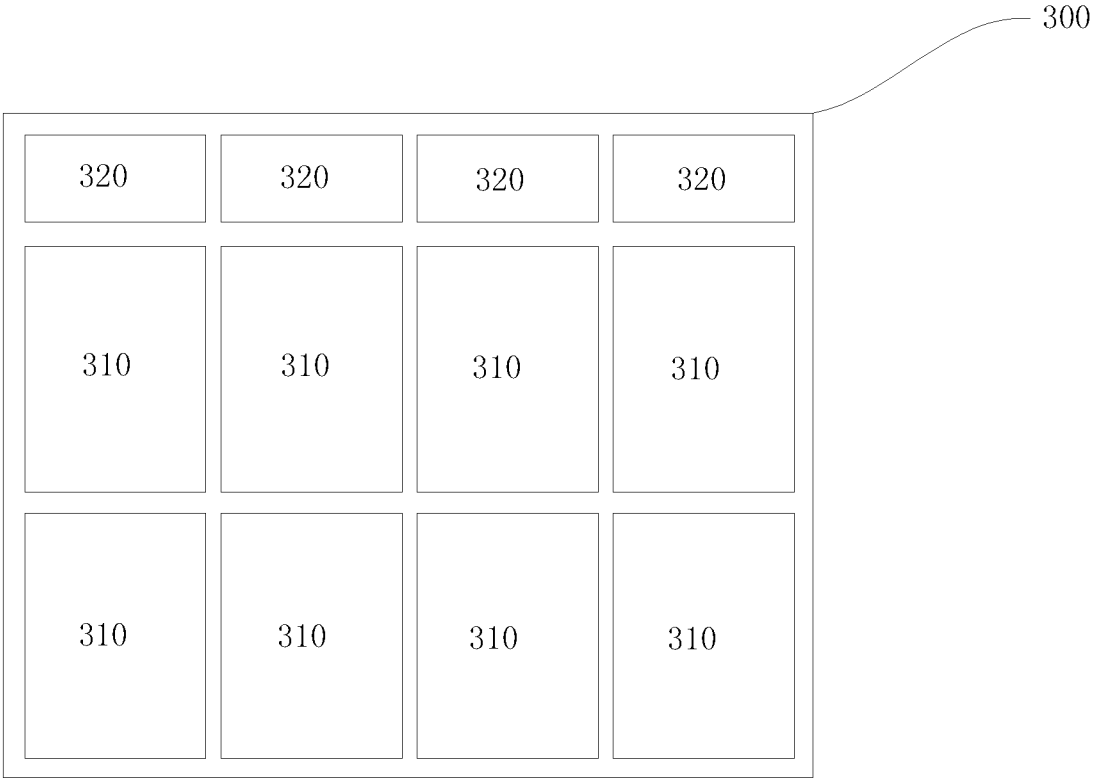
FIG. 3 is an illustrational view showing a glass substrate is cut under "multiple model glass" mode.
Figure 4:
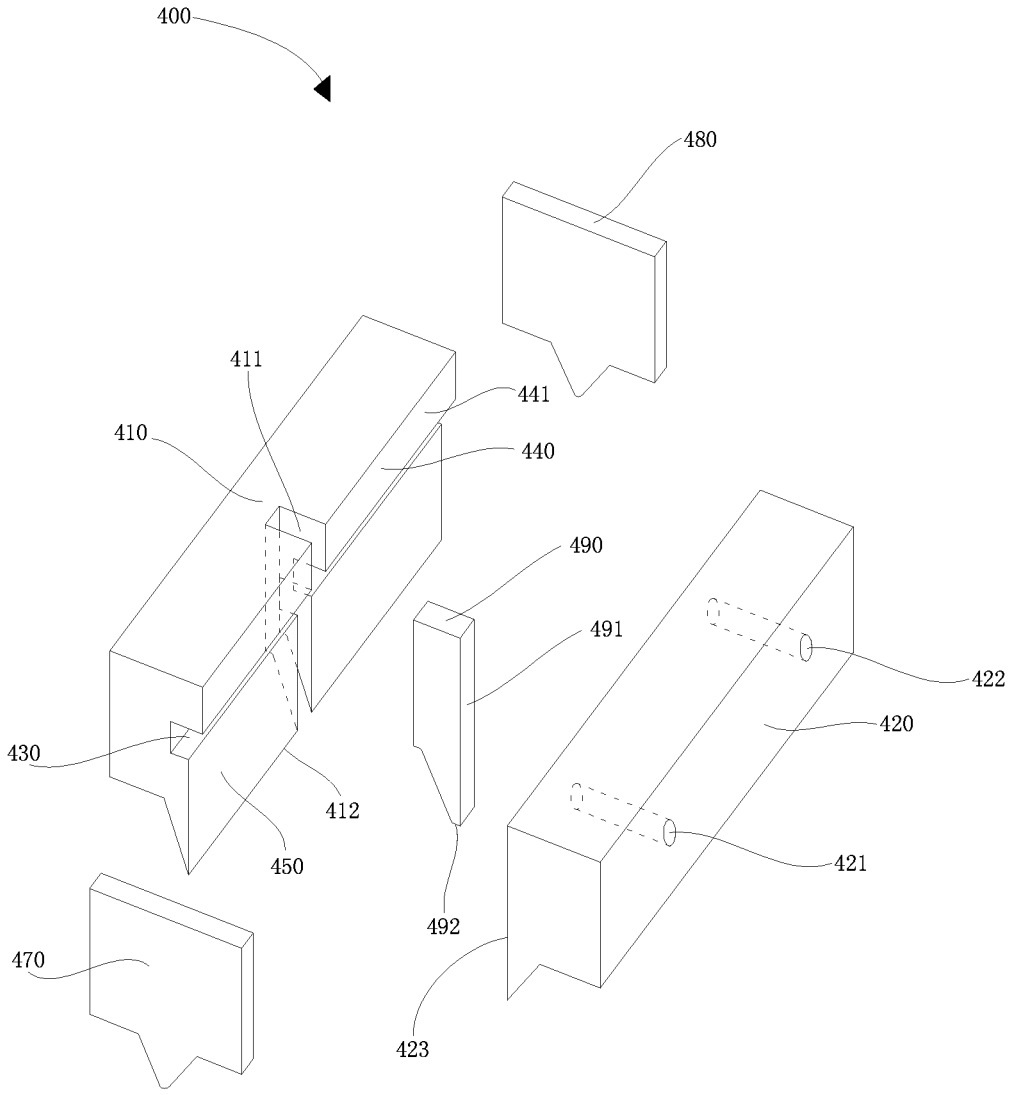
FIG. 4 is an exploded view of a spray nozzle made in accordance with the present invention.
Figure 5:
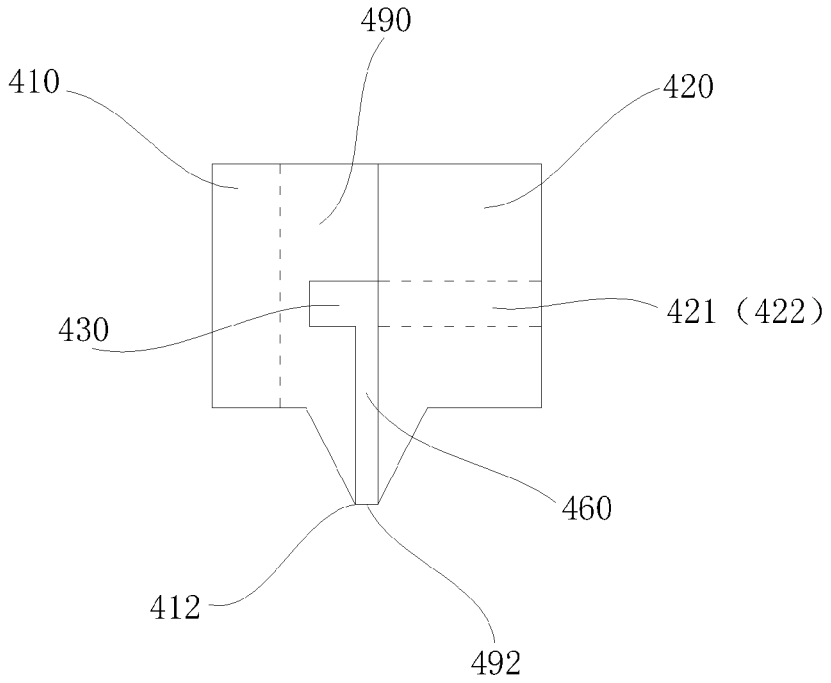
FIG. 5 is a side elevational view of the spray nozzle.

FIG. 4 is an exploded view of a spray nozzle made in accordance with the present invention; and FIG. 5 is a side elevational view of the spray nozzle.

Referring to FIGS. 4 and 5, a spray nozzle 400 made in accordance with the present invention is configured with left and right halves 410, 420. The right half 420 has a planar mating surface 423, and two inlet orifices 421, 422 are defined and arranged at a middle portion of the right half 420. Meanwhile, a reservoir 430 is defined along the longitudinal direction at a middle portion of the left half 410. A mating surface 441 is formed at a portion 440 located above the reservoir 430. A portion 450 located under the reservoir 430 is recessed more then the portion 440, accordingly, a linear opening is defined with respect to the mating surface 423 of the right half 420. This linear opening will become the dimension of the width of the month 460 of the spray nozzle 400.

In addition, when the left and right halves 410 and 420 are mated, both the reservoir 430 and the month 460 have open ends, and as a result, a left and right fenders 470, 480 will be attached to close the opened ends. In the current invention, the fenders 470 and 480 are made from water-repellent material, or the fenders 470 and 480 can be coated with a layer of water repellent material facing inward. On the other hand, the fenders 470 and 480 can be attached to the ends surfaces of the left and right halves 410, 420 with screws or bonding agent.

On the mating surface 441 of the left half 410, a mounting slot 411 is defined, and in which a partition 490 is installed by ways of screws or bonding agent. A mating surface 491 of the partition 490 is closely in contact with the mating surface 423 of the right half 420, and a bottom 492 of the partition 490 is flushed with a bottom of the left half 410 such that the spray nozzle 400 is divided into two individual ejectors. By this arrangement, the spray nozzle 400 can be divided into two individual ejectors with smaller transversal coverage. Accordingly, when the spray nozzle 400 is accelerated or reduced with its speed, both the individual ejectors will give an even and homogeneous spray because the spray delivered from each ejector will have same flow rate at center and ends. On the other hand, when different workloads are requested to have different thickness of layer coated thereon, each individual ejector can be controlled to administer only intended flow rate of the liquid to achieve the goals of deploying different thickness of layers over the different workloads. Details will be given in following paragraph. On alternatively, when different workloads are requested to have coated with different material, then different working agent or liquid can be delivered separately to the ejectors, and accordingly, those different working agent or liquid can be properly sprayed out of the mouth of the different individual ejectors.

It should be noted that in the present invention, the partition 490/mounting slot 411 can be readily adjusted along the mating surface 411 of the left half 410 so as to meet the dimension requirement of the individual ejector, i.e. smaller or larger. Alternatively, with the design of the mold, the partition 490 can be integrally formed with the left half 410 so as to simplify the overall configuration. On the other hand, the quantity of the mounting slots 411 on the mating surface 441 of the left half 410 should not be limited to what disclosed in the drawing. The quantity of the mounting slot 411 can be readily increased or decreased so as to create different type of formation of the individual ejectors on the spray nozzle 400. In addition, in the present invention, the mating surface 423 of the right half 420 can be designed to be identical to the mating surface 441 of the left half 410 so as to modulate the design of the left and right halves 410, 420. As a result, the manufacturing cost will be reduced. On the other hand, the mating surface 423 can be defined with mounting slots which can be offset from the mounting slots 411 of the mating surface 411 of the left half 410.

A spraying apparatus incorporated with the spray nozzle illustrated in FIG. 4 will be detailedly described herebelow.

Figure 6A:
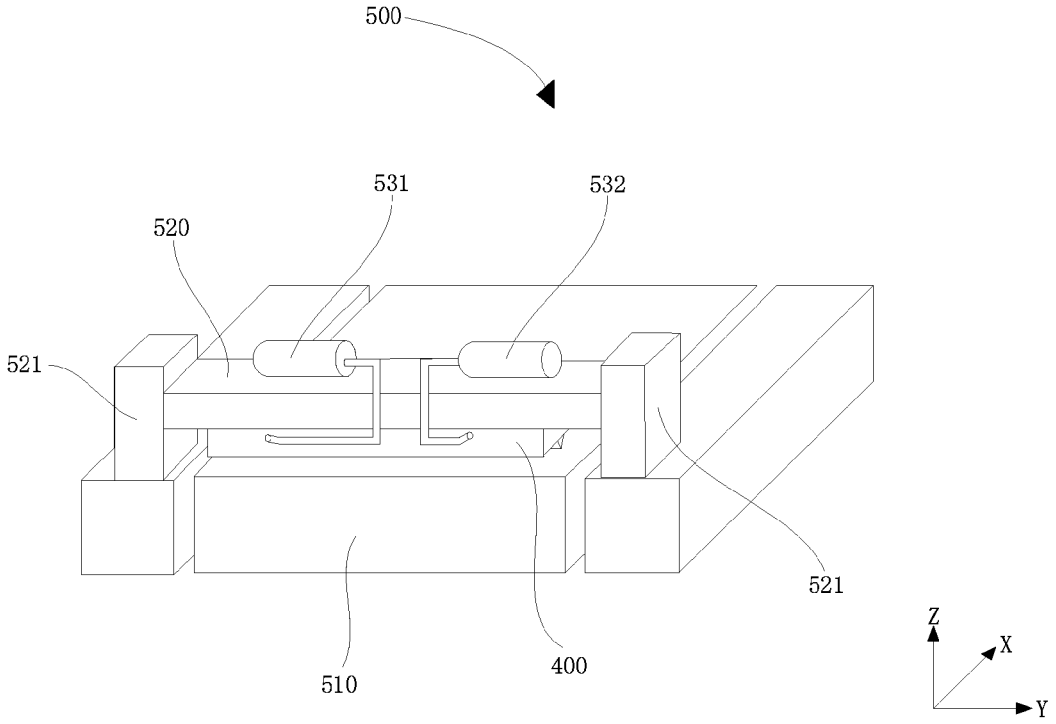
FIG. 6*a* is a spraying apparatus incorporated with the spray nozzle of FIG. 4.

FIG. 6*a* is a spraying apparatus incorporated with the spray nozzle of FIG. 4.

As shown in FIG. 6*a*, the spraying apparatus 500 includes a working table 510 for supporting the workload, the spray nozzle 400 intended to administer spraying over the workload. A shuttle 520 is used to carry the spray nozzle 500 along the x-direction with its transmission axle 521. Accordingly, the spray nozzle 400 can conduct a spray along the horizontal direction. A first pump 531 is used to deliver the working liquid to one of the individual ejectors of the spray nozzle 400, while the other pump 532 delivers the working liquid to the other of the individual ejectors. A controlling system (not shown in Figure) is installed to administer the flow rate of the pumps 531, 532 to each of the individual ejectors and also the horizontal movement of the shuttle 520. Accordingly, with the commands from the from the controlling system, the pumps 531, 532 will deliver the working liquid to the corresponding individual ejectors based on the programmed flow rate, i.e. the flow rate of the working liquid entering the individual ejectors.

In the current invention, the quantity of the pumps can equal to the quantity of the individual ejectors divided from the spray nozzle 400, i.e. each individual ejector is incorporated with a corresponding pump; while alternatively, all the individual ejectors of the spray nozzle 400 can commonly share a common pump. Detailed description will be given herebelow.

Figure 6B:
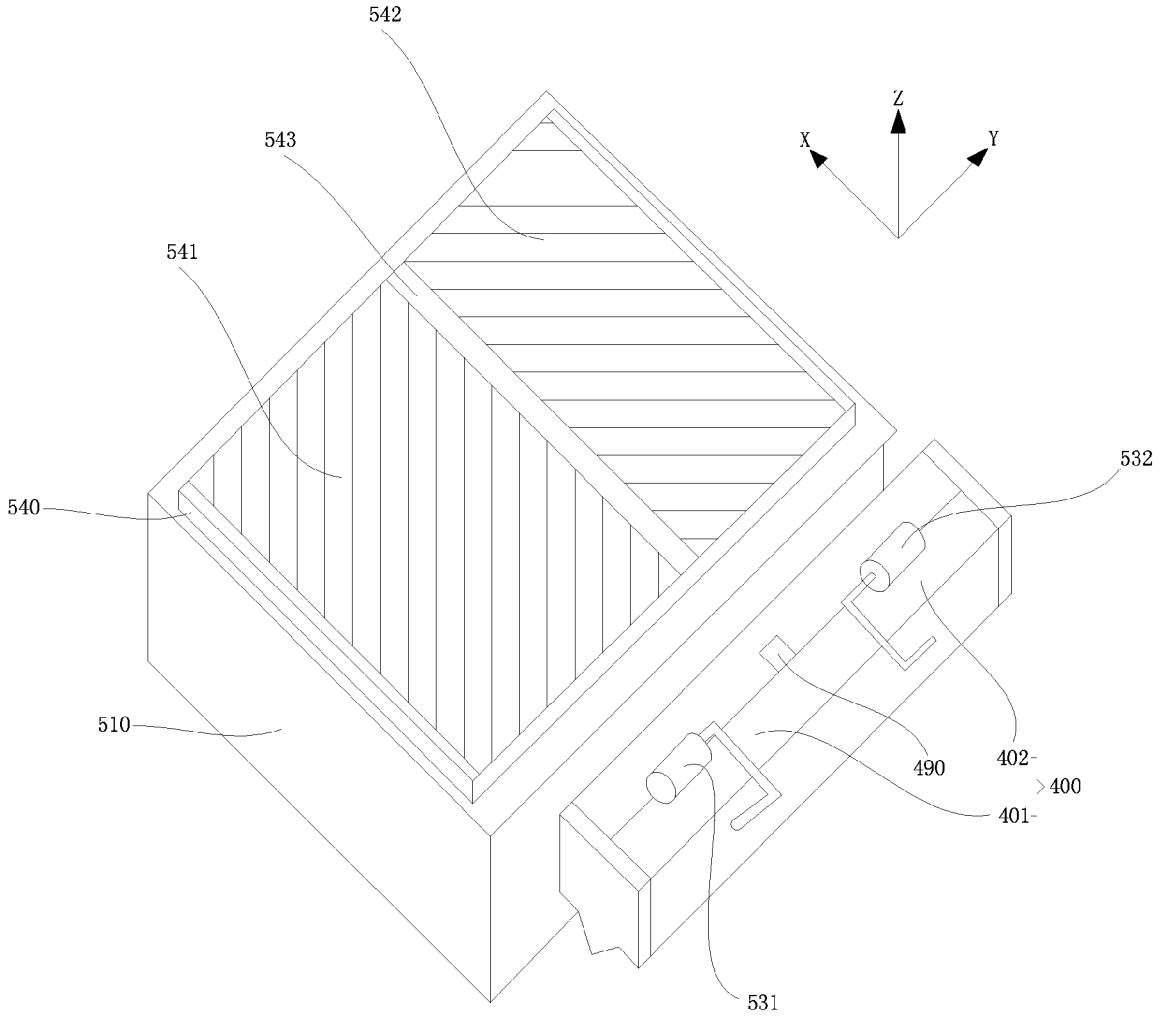
FIG. 6*b* is an illustration showing a workload is processed with the spray nozzle of FIG. 4.

FIG. 6*b* is an illustration showing a workload is processed with the spray nozzle of FIG. 4. In order to readily illustrate what demonstrates therein, the shuttle 520 has been omitted.

As shown in FIG. 6*b*, the workload 540 is disposed onto the working table 510, and the partition 490 is arranged to in align with the border 543 of the spraying zone of the workload 540. Once the flow rate of the pump 531 to the individual ejector 401 is determined, the flow rate of the pump 532 to the individual ejector 402 is determined, then the spray nozzle 400 is commanded to travel along the X-direction such that the individual ejectors 401, 402 will commence spraying over the working zones 541, 542 so as to form a layer of working liquid on the working zones 541, 542 respectively.

The pumping rate of the pump to the individual ejector can be defined with the following formula (1)

$$P=H\times L\times V \quad (1)$$

In which, P is the pumping rate of the pump, H is the intended thickness formed by the individual ejector over the intended working zone; L is the width of the mouth of the individual ejector, and V is the travel speed of the spray nozzle along the X-direction. Normally, the spray nozzle travels at 100 mm/second to 300 mm/second.

Of course, as described above, a single pump can be used to deliver working fluid to both the individual ejectors 401, 402 and will be described herebelow.

Figure 7:
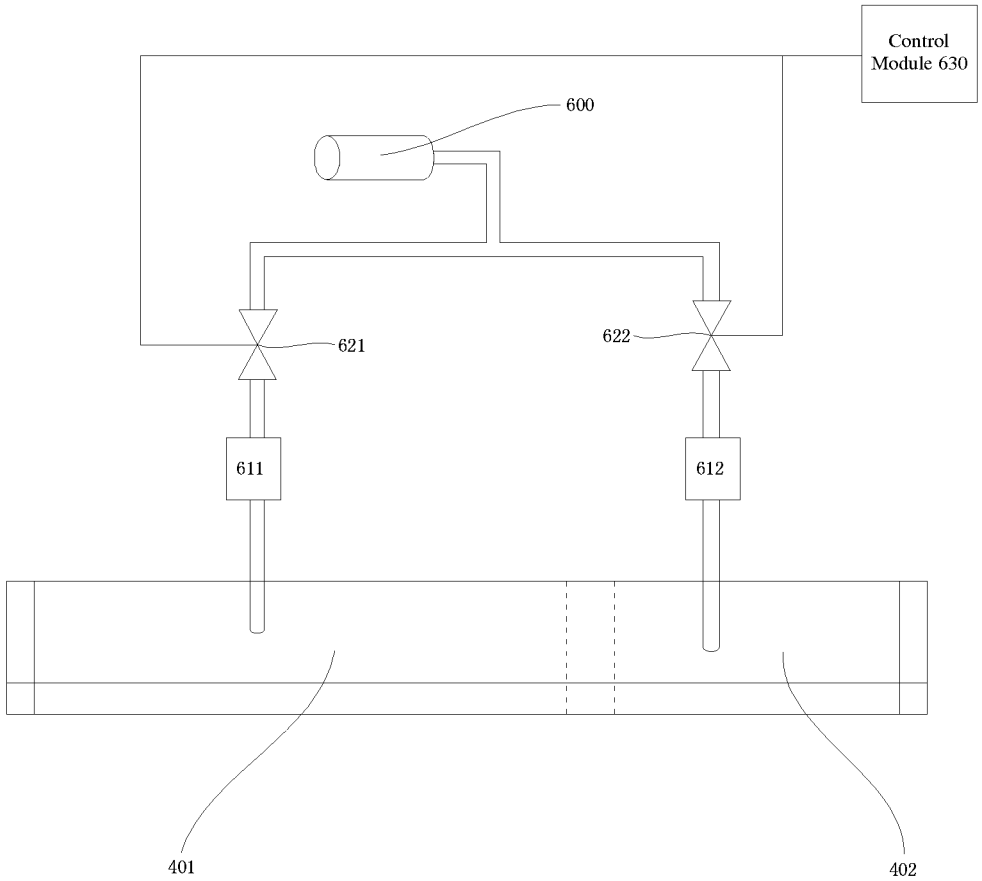
FIG. 7 is an illustrational view of a controlling system in which one pump is utilized.

FIG. 7 is an illustrational view of a controlling system in which one pump is utilized.

As shown in FIG. 7, when only one common pump 600 is used, then the spraying apparatus further includes flow meters 611, 612. The flow meter 611 is used to control the flow rate of the individual ejector 401, and the flow meter 622 is used to control the flow rate of the individual ejector 402. The spraying apparatus further includes valves 621 to control the administering rate of the individual ejector 401, and the valve 622 will be used to control the administering rate of the individual ejector 402. A control module 630 is included to control the valves 621, 622 based on the feedback of the flow meters 611, 612. The valve 621 will be used to control the individual ejector 401, and the valve 622 will be used to control the individual ejector 402.

It should be readily understood that when there are a lot of individual ejectors, the quantity of the valves and flow meters are equal to the quantity of the individual ejectors.

The pumping rate of the pump 600 is defined with the formula (2).

$$P=(H1\times L1+H2\times L2)\times V \quad (2)$$

In which, P is the pumping rate of the pump 600, H1 is the intended thickness formed by the individual ejector 401 over the intended working zone; H2 is the intended thickness formed by the individual ejector 402 over the intended working zone; L1 is the width of the mouth of the individual ejector 401, L2 is the width of the mouth of the individual ejector 402; and V is the travel speed of the spray nozzle along the X-direction.

The spraying apparatus made in accordance with the present invention can be applied to the glass substrate, the semiconductor chip or other workload on which surface treatments with photoresistance or suitable working liquid are needed.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the clams of the present invention.

The invention claimed is:

1. A spraying apparatus, including:

a working table for carrying and supporting a workload;

a spray nozzle for spraying working liquid over the workload;

a shuttle carrying the spray nozzle to move horizontally;

a pump assembly delivering working liquid to the spray nozzle;

a controlling system commanding the movement of the shuttle and adjusting administering rate of the working liquid to the spray shuttle;

wherein the spray nozzle is configured with left and right halves, at least one of the left and right halves being defined with a mating surface in which a recess defining width of a linear opening of the nozzle is defined, each end of the nozzle being mounted with fenders jointly define the linear opening of the nozzle along with the recess, wherein the mating surface in which the recess is defined further includes with a N number of partitions dividing the recess into a N+1 number of individual ejectors, wherein N is a positive integer; and wherein the pump assembly includes N+1 unit pumps each of which is interconnected to a corresponding individual ejector so as to deliver the working liquid thereto.

2. The spraying apparatus as recited in claim 1, wherein the mating surface of one of the left and right halves in which the recess is defined with N number of mounting slots each receives a corresponding partition, each of the partitions includes a mating surface closely in contact with a mating surface of the other half of the left and right halves, bottom of each of the partitions is flushed to bottom of one of the left and right halves in which the recess is defined.

3. The spraying apparatus as recited in claim 1, wherein the N number of partitions are integrally formed with one of the left and right halves in which the recess is defined.

4. The spraying apparatus as recited in claim 2, wherein the N number of partitions are integrally formed with one of the left and right halves in which the recess is defined.

5. A spraying apparatus, including:

a working table for carrying and supporting a workload;

a spray nozzle for spraying working liquid over the workload;

a shuttle carrying the spray nozzle to move horizontally;

a pump assembly delivering working liquid to the spray nozzle;

a controlling system commanding the movement of the shuttle and adjusting administering rate of the working liquid to the spray shuttle;

wherein the spray nozzle is configured with left and right halves, at least one of the left and right halves being defined with a mating surface in which a recess defining width of a linear opening of the nozzle is defined, each end of the nozzle being mounted with fenders jointly define the linear opening of the nozzle along with the recess, wherein the mating surface in which the recess is defined further includes with a N number of partitions dividing the recess into a N+1 number of individual ejectors, wherein N is a positive integer;

wherein N+1 number of flow meters are respectively connected to the individual ejectors, each of the flow meters being used to measuring flow volume of the working liquid to the corresponding individual ejector;

wherein N+1 valves are respectively connected, via the flow meters, to the individual ejectors, each of the valves being used to adjust the flow volume of the working liquid to the corresponding individual ejector; and wherein a flow volume adjusting module is connected and adjusting the corresponding valve to control the flow volume of the working liquid to the individual ejector based on a feedback from the flow volume measured by the flow meter.

6. The spraying apparatus as recited in claim 5, wherein the mating surface of one of the left and right halves in which the recess is defined with N number of mounting slots each receives a corresponding partition, each of the partitions includes a mating surface closely in contact with a mating surface of the other half of the left and right halves, bottom of each of the partitions is flushed to bottom of one of the left and right halves in which the recess is defined.

7. The spraying apparatus as recited in claim 5, wherein the N number of partitions are integrally formed with one of the left and right halves in which the recess is defined.

8. The spraying apparatus as recited in claim 5, wherein the N number of partitions are integrally formed with one of the left and right halves in which the recess is defined.

* * * * *